US006669215B2

(12) United States Patent
Laporte

(10) Patent No.: US 6,669,215 B2
(45) Date of Patent: Dec. 30, 2003

(54) STEERABLE LOCOMOTION DEVICE FOR SPORT OR LEISURE

(75) Inventor: Christophe Frederic Laporte, Cran Gevrier (FR)

(73) Assignee: Hoggar Solution, Annecy-Le-Vieux (FR)

( * ) Notice: Subject to any disclaimer, the term of this patent is extended or adjusted under 35 U.S.C. 154(b) by 0 days.

(21) Appl. No.: 10/088,915

(22) PCT Filed: Jan. 2, 2002

(86) PCT No.: PCT/FR02/00005

§ 371 (c)(1),
(2), (4) Date: Jul. 22, 2002

(87) PCT Pub. No.: WO02/055162

PCT Pub. Date: Jul. 18, 2002

(65) Prior Publication Data

US 2003/0122334 A1 Jul. 3, 2003

(30) Foreign Application Priority Data

Jan. 12, 2001 (FR) ..... 01 00430

(51) Int. Cl.[7] ..... B62M 1/12
(52) U.S. Cl. ..... 280/87.042; 280/124.11
(58) Field of Search ..... 280/87.01, 87.041, 280/87.042, 87.043, 87.05, 263, 267, 124.11, 124.177, 7.15, 11.12, 22.1

(56) References Cited

U.S. PATENT DOCUMENTS 3,331,612 A * 7/1967 Tietge ..... 280/11.28
3,671,055 A * 6/1972 Aarup ..... 280/87.01
3,876,217 A * 4/1975 Copier ..... 280/11.225
3,995,873 A 12/1976 Pantzar ..... 280/87.042
4,120,508 A * 10/1978 Brown et al. ..... 280/11.28
4,140,326 A * 2/1979 Huber ..... 280/87.042
4,150,838 A 4/1979 Lappage ..... 280/87.042
4,196,916 A * 4/1980 Schorr ..... 280/87.042
4,445,699 A * 5/1984 Darasko ..... 280/87.041
4,617,871 A * 10/1986 Yau ..... 114/39.24
4,744,576 A * 5/1988 Scollan, Jr. ..... 280/87.042
D302,994 S * 8/1989 Hawkes et al. ..... D21/765
4,865,342 A * 9/1989 Kong ..... 280/87.042
4,887,824 A * 12/1989 Zatlin ..... 280/87.042
4,991,861 A * 2/1991 Carn et al. ..... 280/87.042
5,048,851 A * 9/1991 Alarcon ..... 280/87.042
5,160,155 A 11/1992 Barachet ..... 280/87.042
5,474,314 A * 12/1995 Lehman ..... 280/87.042
5,551,717 A * 9/1996 De Courcey Milne . 280/87.042
5,707,068 A 1/1998 Bradfield ..... 280/87.042
5,855,385 A * 1/1999 Hambsch ..... 280/87.042
6,318,739 B1 * 11/2001 Fehn, Jr. ..... 280/11.28
6,398,237 B1 * 6/2002 Attey ..... 280/87.042
6,488,295 B1 * 12/2002 Bryant ..... 280/87.042
6,520,517 B1 * 2/2003 Chung et al. ..... 280/87.042

* cited by examiner

*Primary Examiner*—Brian L. Johnson
*Assistant Examiner*—Bridget Avery
(74) *Attorney, Agent, or Firm*—Dowell & Dowell P.C.

(57) ABSTRACT

A locomotion device includes a chassis adapted to accommodate at least one user and which is supported-by ground engaging members. At least one of these members is mounted on a steering column articulated with respect to the chassis about an axis of rotation. The device includes a frame kinematically connected to the steering column and movable with respect to the chassis and adapted to come into contact with the ground with the frame making it possible to control rotation of the steering column about its axis.

34 Claims, 11 Drawing Sheets

STEERABLE LOCOMOTION DEVICE FOR SPORT OR LEISURE

BACKGROUND OF THE INVENTION

1. Field of the Invention

The present invention relates to a locomotion device for sport or leisure intended to be used for moving over ground, preferably sloping ground.

2. Description of the Related Art

In the domain of winter sports, it is known to use a snowboard for moving over a snow-covered slope, the user guiding the board by the positioning of his/her body above the board, this inducing variations of the centre of gravity of the assembly formed by the surfer and the board. In practice, the use of a snowboard is limited to the winter season in the majority of regions.

Furthermore, it is known, for example by WO-A-99/48750, to produce a locomotion device which comprises an elongated chassis on which is mounted a pivoting sub-assembly for steering adapted to be manoeuvred by a seated user with his feet. The sensation of piloting is similar to that felt with a go-kart.

Other devices such as summer sledges are controlled like a skate board, i.e. by inclining a chassis on which the user places his feet with respect to an axis of a steering axle. The sensation of piloting is close to that obtained with a skate board.

SUMMARY OF THE INVENTION

The invention aims at proposing a novel locomotion device structure which makes it possible to feel new sensations of piloting, including over ground not covered with snow, these sensations of piloting being closer to those usually obtained with a snowboard.

In this spirit, the invention relates to a locomotion device for sport or leisure comprising a chassis adapted to accommodate at least one user and resting on the ground via engaging members, of the wheel or runner type, at least one of these members being mounted on a steering column articulated, with respect to the chassis, about an axis of rotation. This device is characterized in that it comprises a frame kinematically connected to the steering column, mobile with respect to the chassis and adapted to come into contact with the ground, this frame making it possible, by its movements with respect to the chassis, during abutments on the ground, to control rotation of the steering column about its axis.

Thanks to the invention, the frame capable of coming into abutment against the ground is used as the means for controlling the steering wheel or wheels or the or steering runner or runners. It therefore suffices for the user to incline the device in the direction of the ground for the frame to interact with the ground and consequently control the rotation of the steering column. Abutment of the frame on the ground may be obtained by the user modifying the position of his centre of gravity with respect to the device, similarly to that used with a snowboard. Change of direction is obtained by modifying the inclination of the chassis with respect to the frame. When the latter is in contact with the ground, the degree of inclination of the chassis may be modified by the user with his feet, without necessarily offsetting his centre of gravity, which makes it possible to vary the radius of curvature of the trajectory of the device.

According to advantageous but non-obligatory aspects of the invention, the locomotion device incorporates one or more of the following characteristics:

It comprises a single ground-engaging member disposed at one end, front or rear, of the chassis and a single ground-engaging member disposed at the other end, rear or front, of the chassis. In that case, each ground-engaging member may be provided to be mounted on a steering column articulated with respect to the chassis and kinematically connected to the frame, the frame being adapted to control rotation of each steering column about its own axis of rotation.

The axis of rotation of the steering column is inclined with respect to the vertical when the device rests on horizontal ground. This inclination of the steering column corresponds to the notion of steering error angle which may be defined over a cycle and the non-zero nature of the steering error angle of the steering column improves the stability of the device. However, this non-zero nature is optional.

Means are provided for returning the frame towards a position with respect to the chassis such that the ground-engaging member mounted on the steering column is oriented so that the device can move substantially in a straight line. These return means allow the device to advance in a straight line by default. These return means may be provided to be elastic and with adjustable elasticity.

Means are provided for damping vibrations between the ground and a user in place on the chassis, these means comprising wheels having low-pressure pneumatic tyre or elastic tyre, at least one telescopic damping fork, shock absorbers integrated in the chassis and/or a chassis with elastic memory.

The steering column bears a catch extending in a substantially radial direction with respect to its axis of rotation, while the frame is fast with a fork adapted to interact with this catch in order to control rotation of the column about this axis.

The frame is articulated on the chassis about an axis substantially parallel to the direction of displacement of the device in a straight line.

The means for connection between the frame and the steering column, the geometry of the frame and/or the geometry of the chassis are adjustable, which makes it possible to modify the conditions of piloting of the device and the sensations experienced. This also allows the conditions of piloting to be adapted to the morphology and/or athletic ability of the user.

The frame may be substantially in the form of a closed loop. It may also be formed by two half-frames kinematically connected to a front steering column and to a rear steering column, respectively, of the device. According to another approach, the frame may be substantially in S or Z form, having its respective ends kinematically connected to a front steering column and to a rear steering column, respectively, of the device.

The frame is equipped with at least one removable runner provided to come into contact with the ground. Such a runner protects the frame from shocks and may be changed as a function of its wear. The frame may also be equipped with a removable device incorporating caster(s) or roller(s) performing the same function.

An elastic net is provided between the chassis and the frame.

The chassis comprises a cradle substantially in the form of a loop and covered with a board adapted to support a user. According to another approach, the chassis comprises a cradle formed by two half-cradles each fast with a steering column and connected by a tie-piece. In that case, these half-cradles are advantageously articulated with respect to the tie-piece, with possibility of limited rotation, which makes it possible to dampen the shocks and/or vibrations. These two half-chassis may also be covered with a board adapted to support a user.

In the case or a supporting board being used, damping means may be arranged between the cradle and this board.

The means for connection between the frame and the steering column include means for returning the frame towards a position with respect to the chassis such that the ground-engaging member mounted on the steering column is oriented so that the device can move substantially in a straight line.

According to a first form of embodiment, the connection means comprise an element made of supple plastics material forming a sleeve adapted to surround an arm for controlling the steering column in rotation, this element forming at least one housing for receiving part of the frame.

According to another form of embodiment, an elastic member is adapted to slide on an arm controlling the steering column in rotation, this elastic member being fast with an element connected to a shank of the steering column. In that case, a fork fast with the element connected to the shank may be provided, adapted to alternately compress the elastic member against the arm controlling the steering column.

According to another form of embodiment, the connection means comprise a member articulated on an arm controlling the steering column and forming a fork adapted to cooperate with a shaft fixed with respect to the shank of the column.

According to another form of embodiment, the connection means comprise an elastically deformable endpiece, mounted on an arm controlling the steering column and connected to the frame by connecting rods or cables.

Means are provided for compensating the necessary clearance between the frame and the chassis in order to allow deformations of the cradle of this chassis. In that case, these compensation means advantageously include a compression spring disposed inside a sleeve fast with the frame, this spring surrounding a pin and exerting on part of it a clearance-compensating force.

BRIEF DESCRITPION OF THE DRAWINGS

The invention will be more readily understood and other advantages thereof will appear more clearly in the light of the following description of seven forms of embodiment of a locomotion device in accordance with its principle, given solely by way of example and made with reference to the accompanying drawings, in which.

Figure 3:
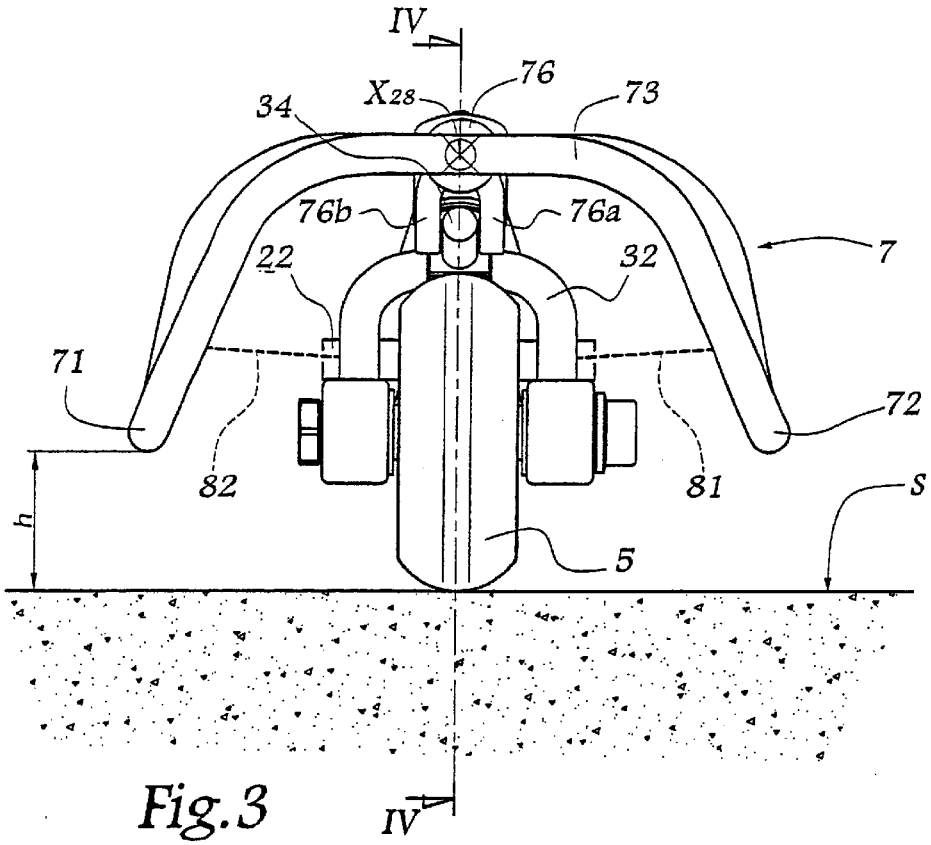
FIG. 3 is an end view, from the front, of the device of FIGS. 1 and 2.
Figure 4:
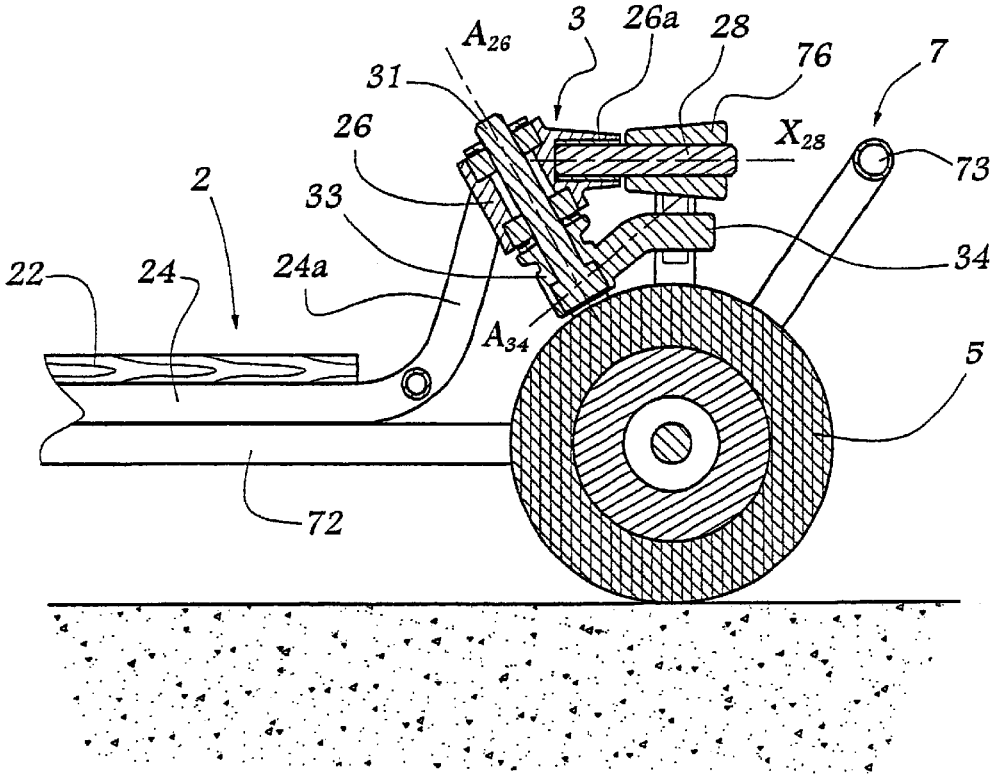
FIG. 4 is a partial section of the device of FIGS. 1 to 3 along line IV—IV of FIG. 3.
Figure 5:
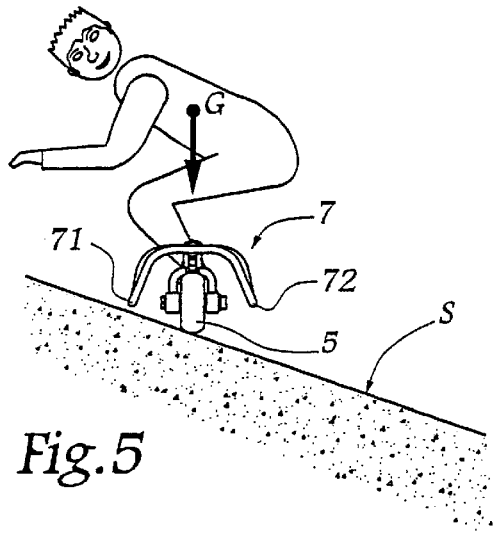

FIG. 5 schematically shows the device of FIGS. 1 to 4 in the course of being used along a rectilinear trajectory.

Figure 6:
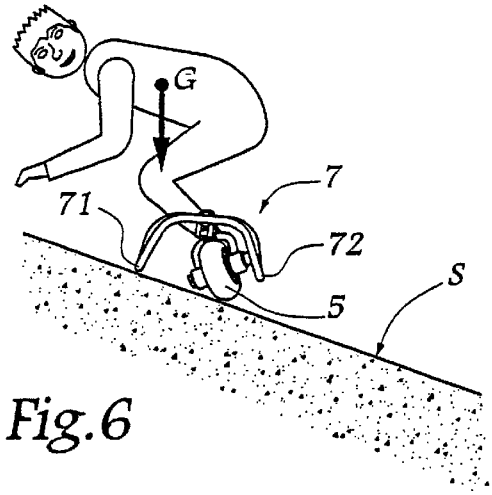

FIG. 6 is a view similar to FIG. 5 when the device is used in a bend.

Figure 7:
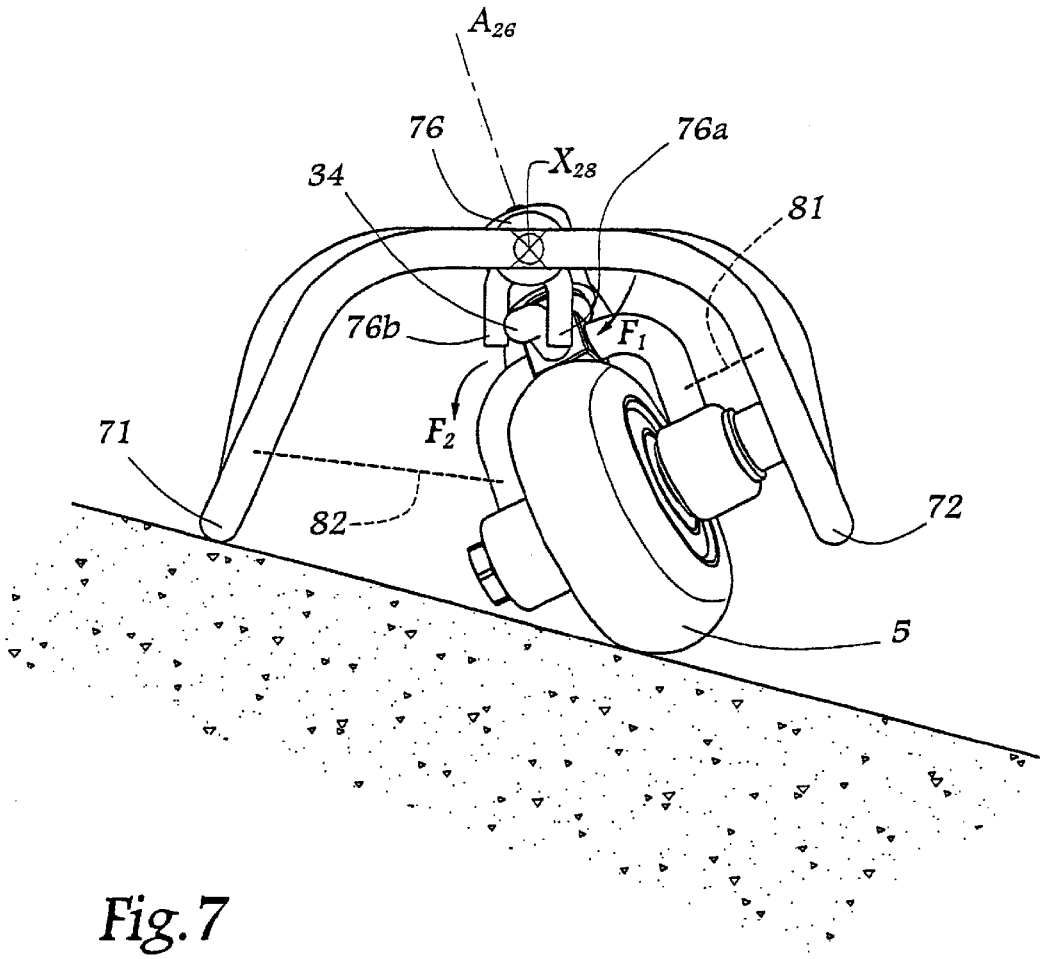

FIG. 7 is a view similar to FIG. 3 when the device is in the configuration of use of FIG. 6.

Figure 8:
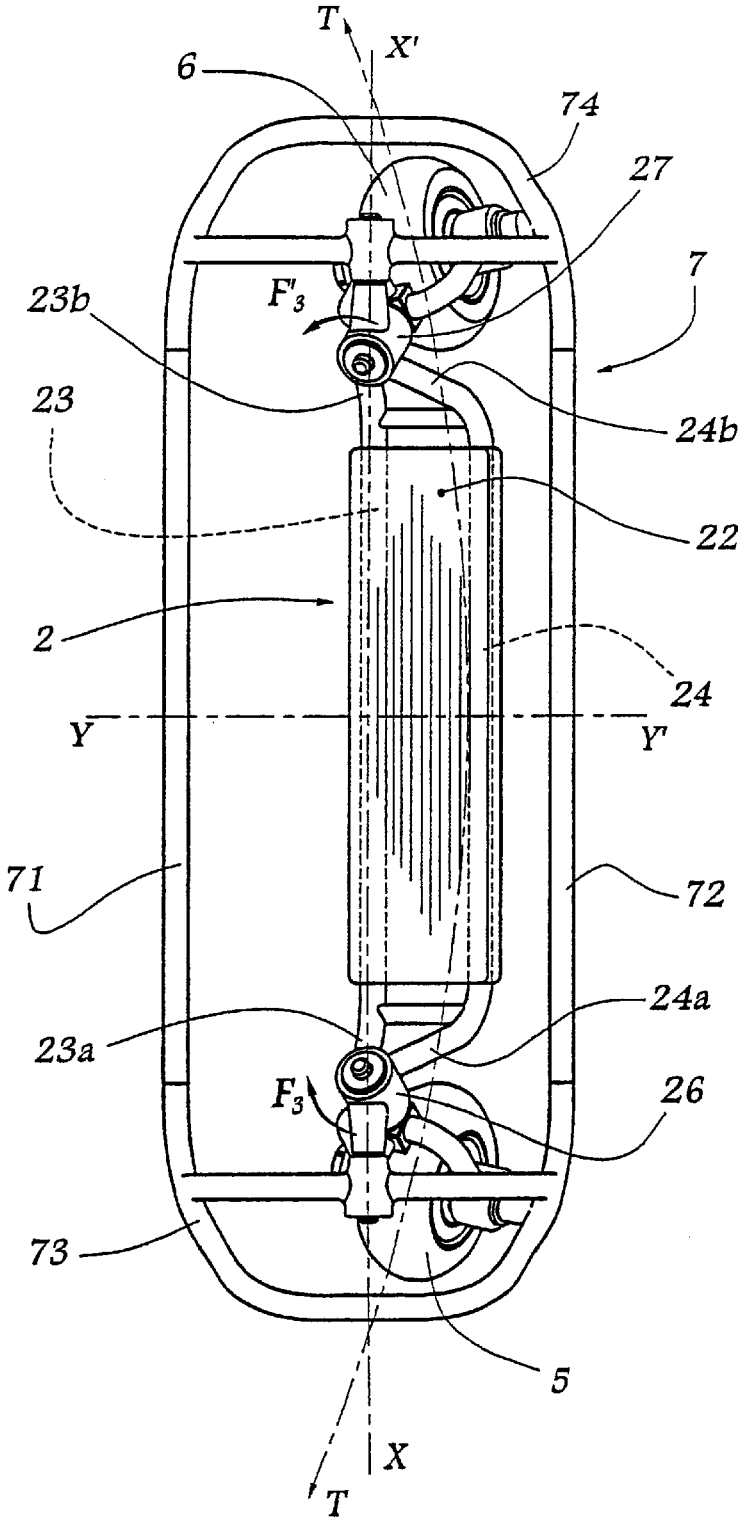

FIG. 8 is a plan view of the device alone in the configuration of FIGS. 6 and 7.

Figure 9:
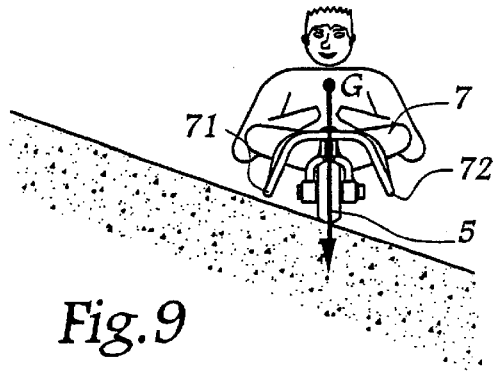

FIG. 9 is a view similar to FIG. 5 while the user is in another position.

Figure 10:
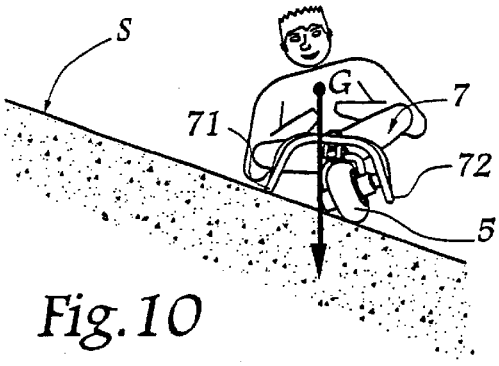

FIG. 10 is a view similar to FIG. 6 while the user is in the position of FIG. 9.

Figure 11:
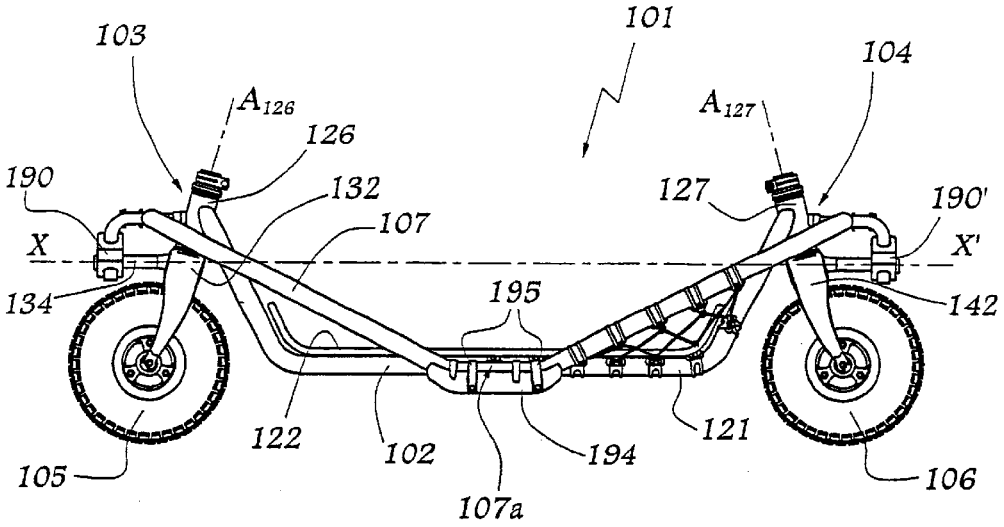

FIG. 11 is a side view of a device in accordance with a second form of embodiment of the invention.

Figure 12:
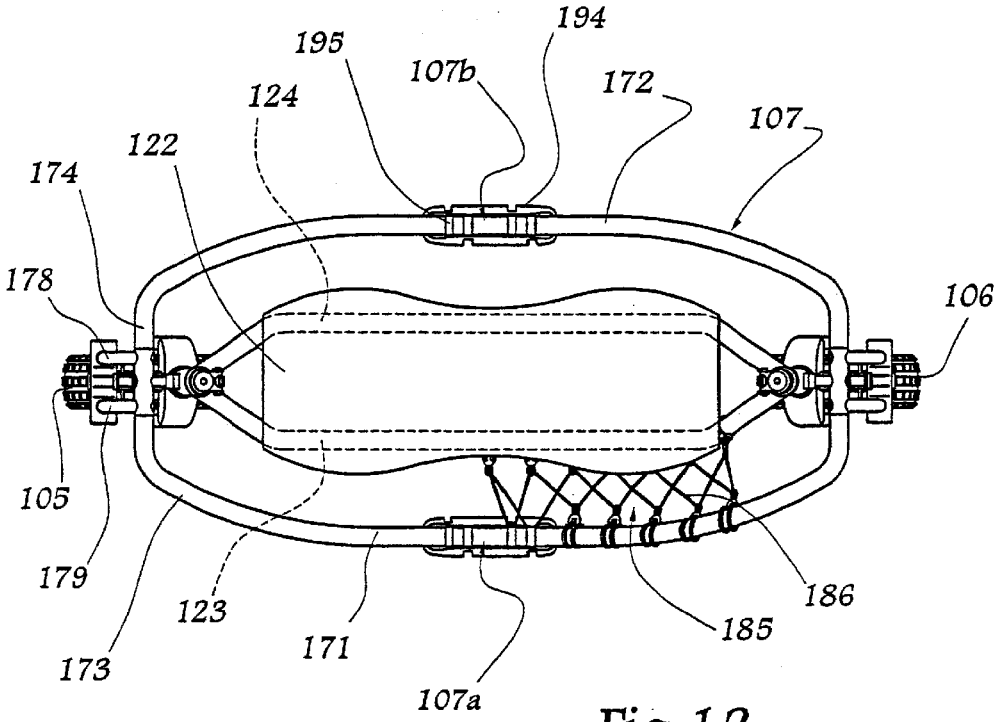

FIG. 12 is a plan view of the device of FIG. 11.

Figure 13:
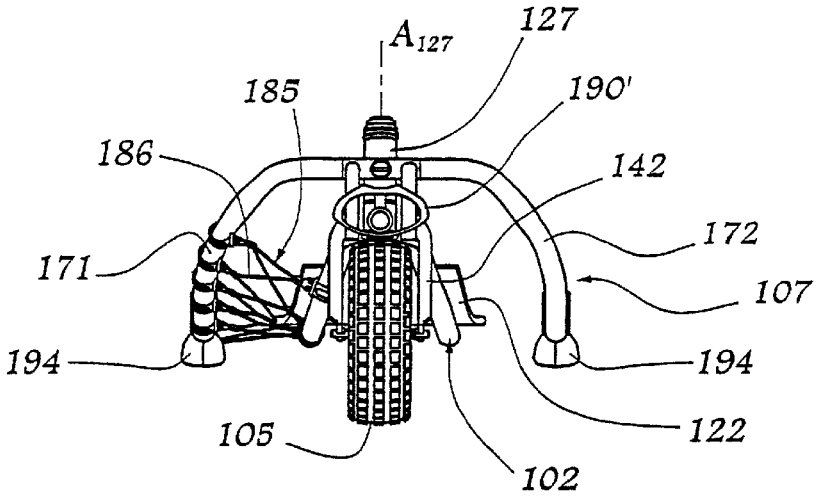

FIG. 13 is an end view, from the front, of the device of FIGS. 11 and 12.

Figure 14:
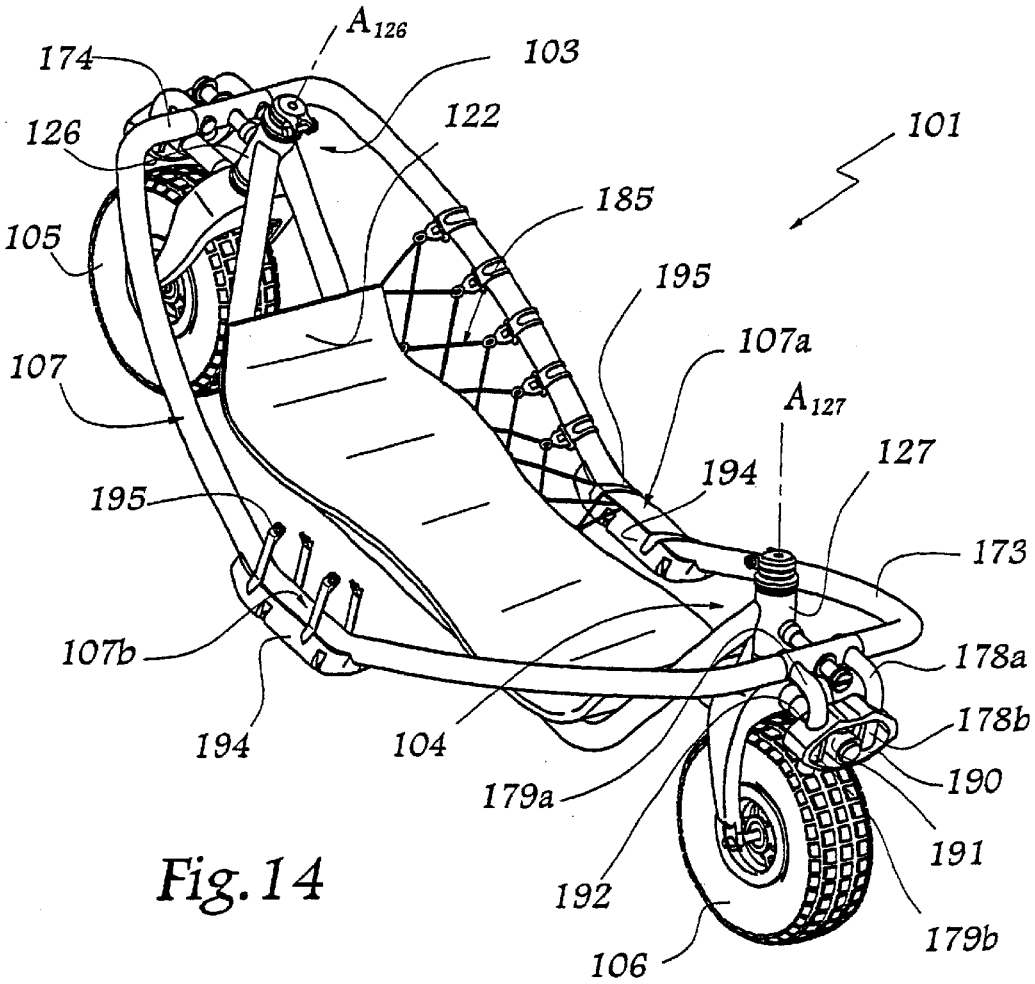

FIG. 14 is a view in perspective of the device of FIGS. 11 to 13.

Figure 15:
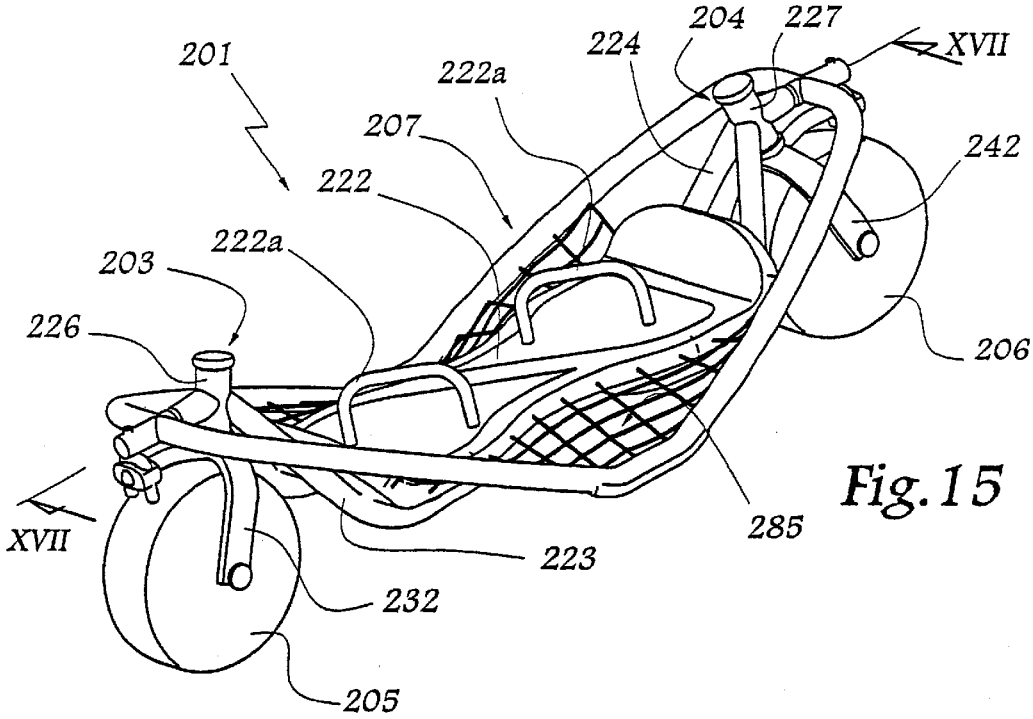

FIG. 15 is a view in perspective of a device in accordance with a third form of embodiment of the invention.

Figure 16:
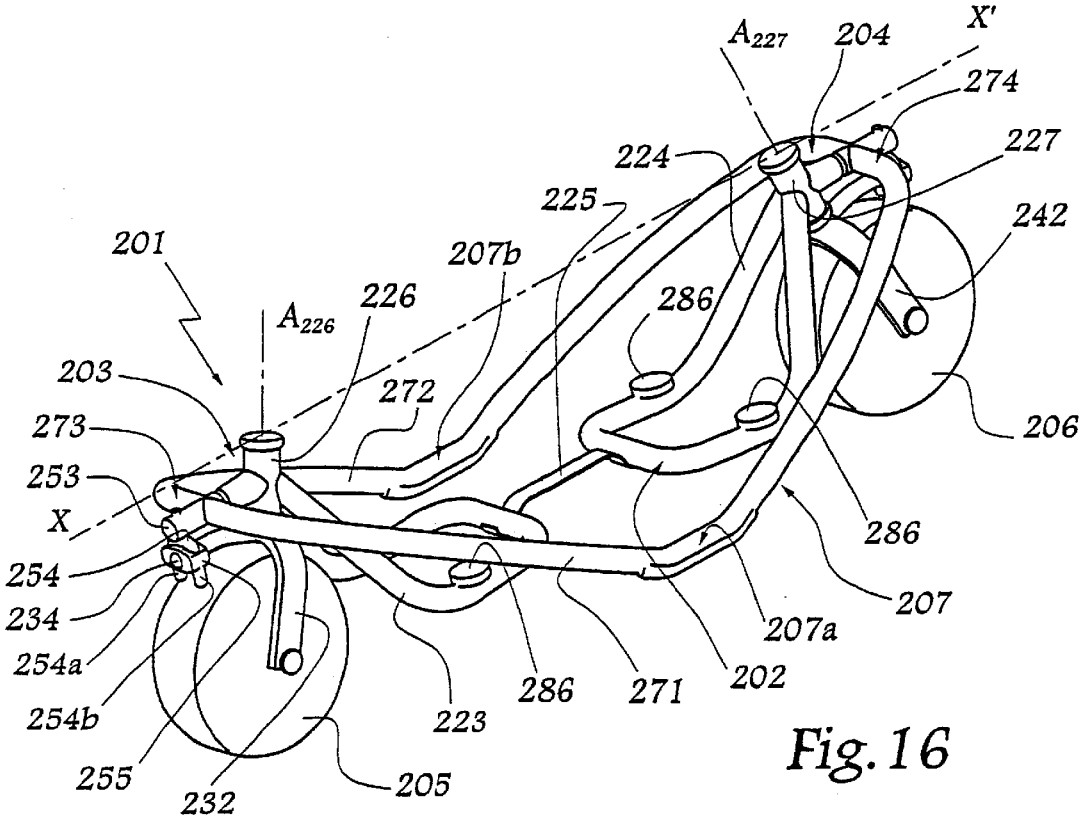

FIG. 16 is a view similar to FIG. 15, while certain elements of the device have been omitted in order to render the drawing clearer.

Figure 17:
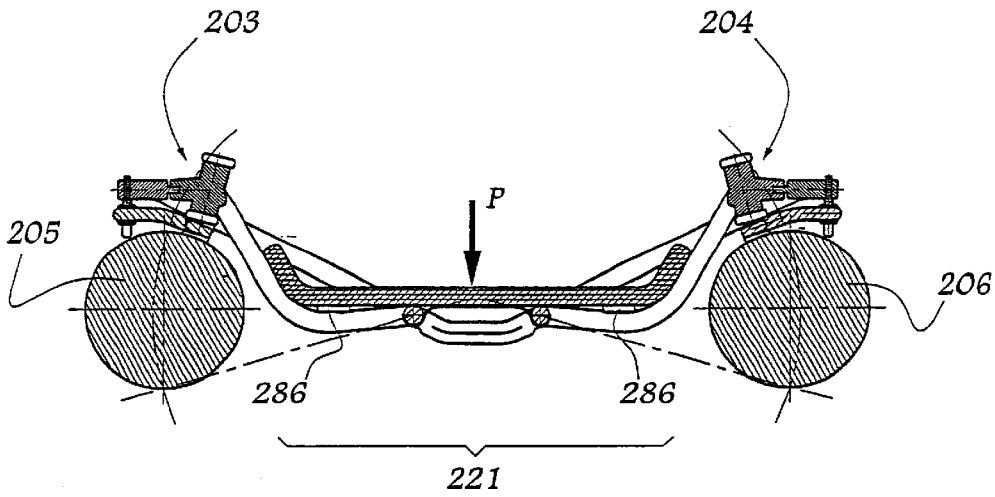

FIG. 17 schematically shows a longitudinal section of the device of FIGS. 15 and 16.

Figure 18:
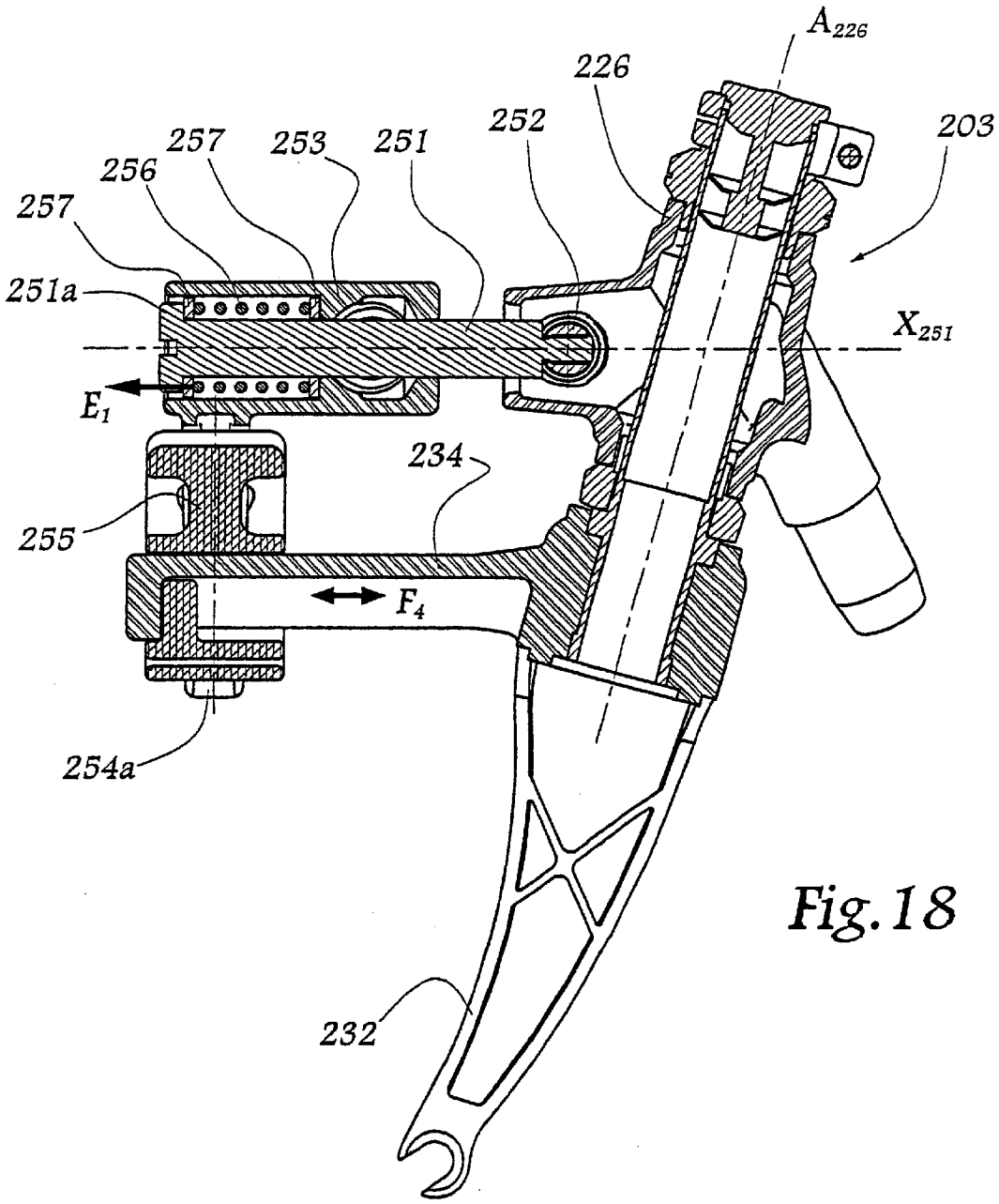

FIG. 18 is a section on a larger scale of part of the device of FIGS. 15 and 17.

Figure 19:
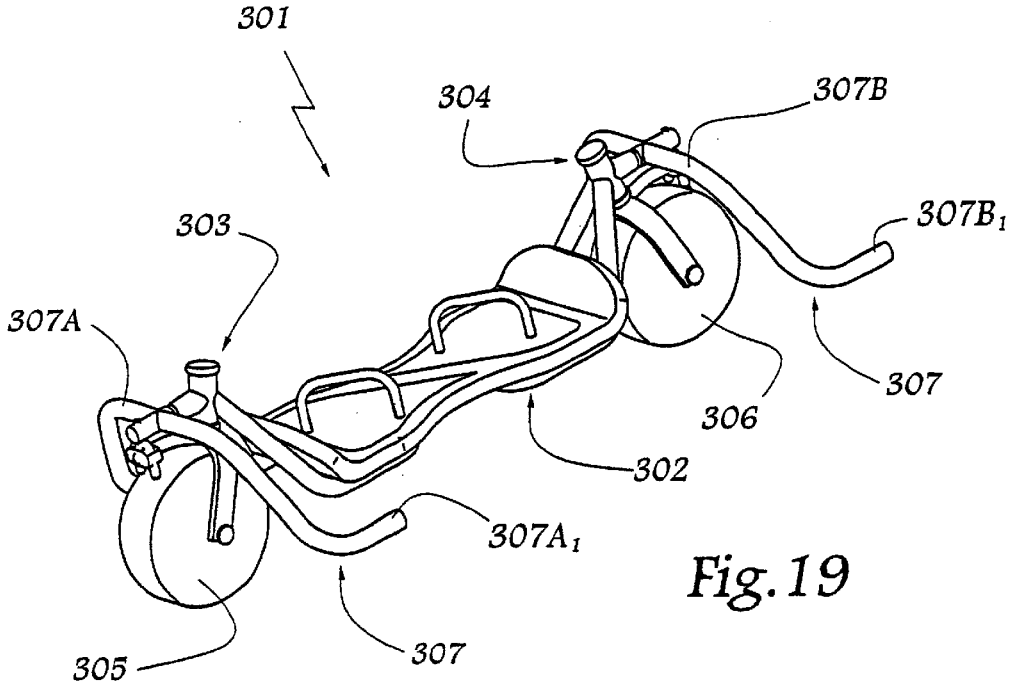

FIG. 19 is a view in perspective of a device in accordance with a fourth form of embodiment of the invention.

Figure 20:
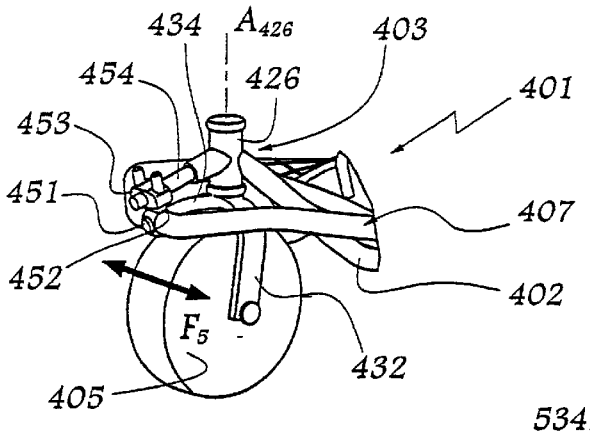

FIG. 20 is a partial view in perspective of a device in accordnce with a fifth form of embodiment of the invention.

Figure 21:
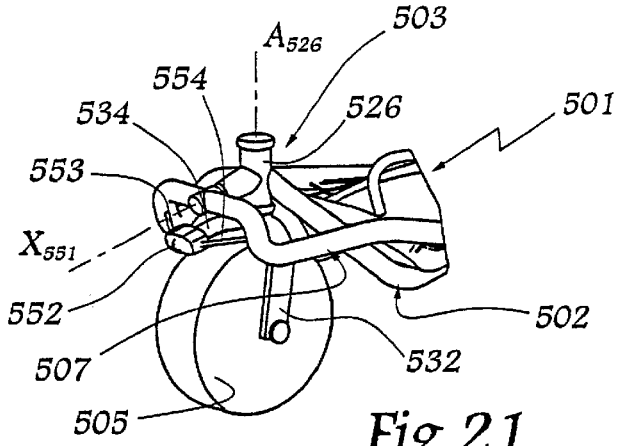
Figure 22:
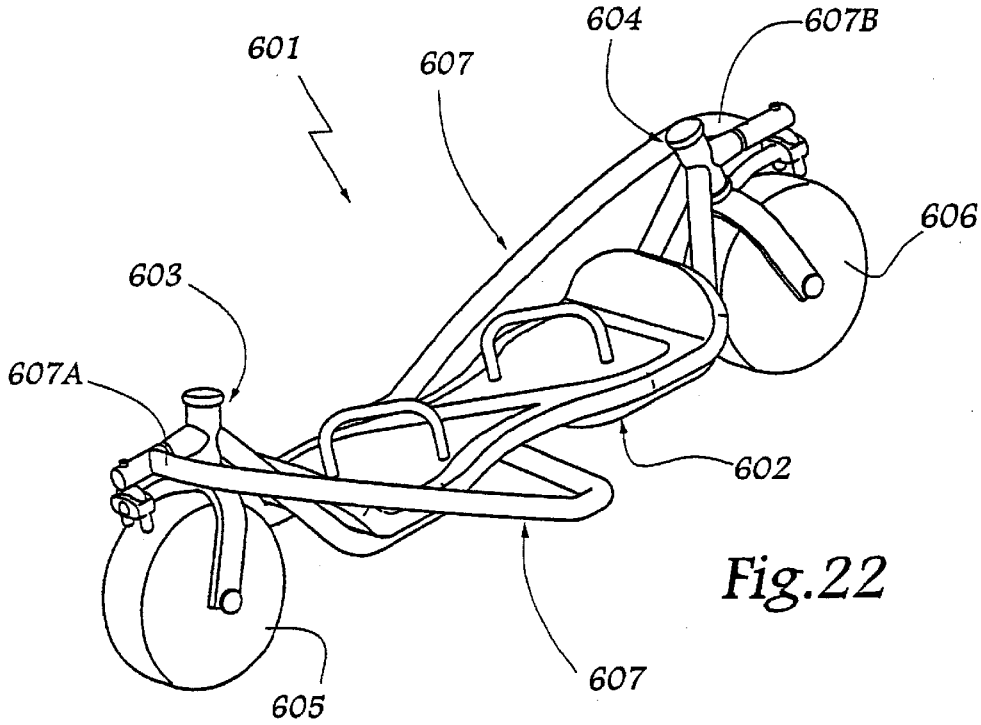

FIG. 21 is a view similar to FIG. 20 for a device in accordance with a sixth form of embodiment of the invention, and FIG. 22 is a view in perspective of a device in accordance with a seventh form of embodiment of the invention.

DESCRITPION OF THE PREFERRED EMBODIMENTS

The locomotion device 1, shown in the Figures and in accordance with the invention, comprises a chassis 2 including a tubular cradle 21 and a supporting board 22 mounted on this cradle. The cradle 21 comprises two tubes 23 and 24 which are substantially parallel and rectilinear, the ends 23*a*, 23*b*, 24*a* and 24*b* of these tubes being curved upwardly and joining at the level of two shanks 26 and 27.

X–X' denotes a longitudinal axis of the chassis 2. This axis is parallel to the tubes 23 and 24 in their central parts and traverses the shanks 26 and 27. This axis corresponds to the direction of advance of the device 1 in a straight line.

Y–Y' denotes an axis transverse to the chassis 2, this axis being perpendicular to axis X–X' and parallel to the median plane of the board 22. Finally, Z–Z' denotes a central vertical axis of the device 1 when the latter rests on horizontal ground S, axis Z–Z' being perpendicular to axes X–X' and Y–Y'.

$A_{26}$ denotes the central axis of the shank 26, $A_{27}$ denotes the central axis of the bush 27.

Axis $A_{26}$ is included in a plane defined by axes X–X' and Z–Z' and inclined, in this plane, with respect to axis Z–Z' by an angle $\alpha$ equal to about 30°. Similarly, axis $A_{27}$ is included in the plane defined by axes X–X' and Z–Z' and inclined by an angle $\beta$ of about 30° with respect to axis Z–Z'. Axes $A_{26}$ and $A_{27}$ are convergent in the direction of axis Z–Z' opposite the ground S, i.e. upwardly in FIG. 1.

The device also comprises two steering columns 3 and 4 respectively engaged inside the shanks 26 and 27.

As is particularly visible in FIG. 4, the column 3 comprises a shaft 31 aligned on axis $A_{26}$ and connected to a fork 32 in which a wheel 5 is mounted. On the shaft 31 is likewise mounted a shank 33 fast with the fork 32 and provided with a curved finger 34 projecting in a substantially radial direction with respect to the shaft 31 and represented by axis $A_{34}$.

The column 4 is similar to column 3 and likewise comprises a fork 42 in which a wheel 6 is mounted.

Figure 1:
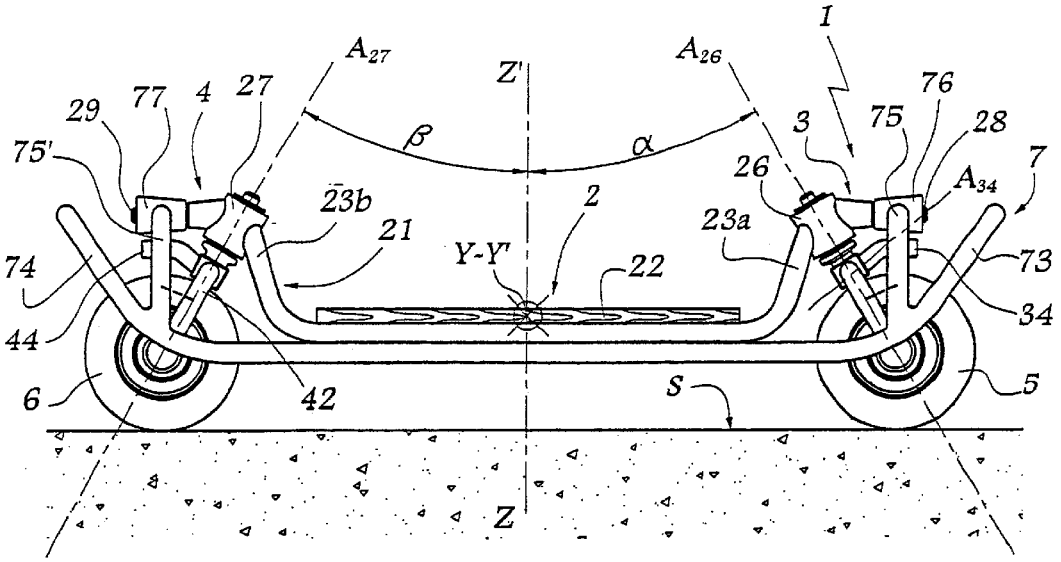
FIG. 1 is a side view of a locomotion device according to a first form of embodiment of the invention.
Figure 2:
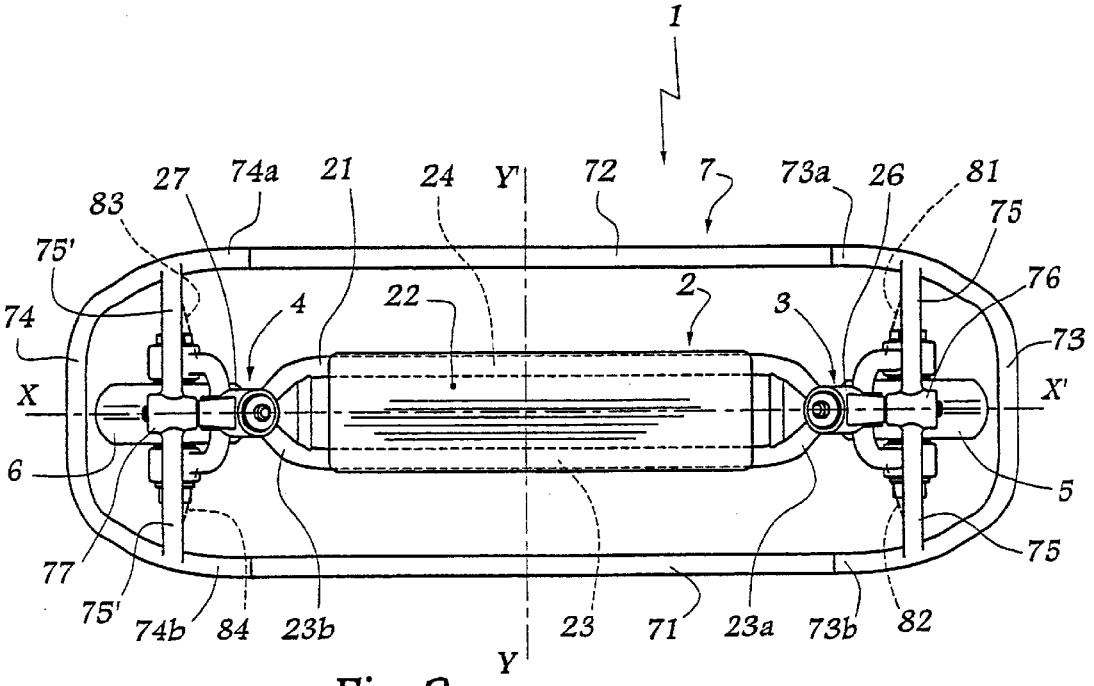
FIG. 2 is a plan view of the device of FIG. 1.

By hypothesis, it is considered that column 3 is mounted at the front of the device 1 while column 4 is mounted at the rear thereof, the direction of displacement of the device 1 in FIG. 1 being from left to right. However, this is pure convention, insofar as the device 1 is symmetrical with respect to the plane defined by axes Y–Y' and Z–Z' and it also allows a displacement towards the left in FIG. 1.

The shank 26 forms a concave housing 26*a* for receiving a shaft 28 extending along an axis $X_{28}$ parallel to axis X–X' and coplanar to axes X–X' and Z–Z'.

In the same way, bush 27 forms a housing for receiving a shaft 29 extending along the same axis $X_{28}$.

A frame 7 is articulated on chassis 2, being mounted to pivot about shafts 28 and 29. The frame 7 comprises a tubular structure formed by two tubes 71 and 72 substantially parallel to the tubes 23 and 24 and located on either side of the chassis 2. The tubes 71 and 72 are respectively connected to the front and to the rear of the device 1 by upwardly curved tubes 73 and 74.

The tube 73 is also connected to two struts 75 which join at the level of a shank 76 intended to be disposed around the shaft 28. Similarly, the tube 74 is connected by two struts 75' to a shank 77 disposed around the shaft 29. In this way, the frame 7 may pivot about axis $X_{28}$ with respect to the rest of the device 1.

The shank 76 is equipped with two clips 76*a* and 76*b* between which the finger 34 is engaged, the clips 76*a* and 76*b* forming a sort of fork for receiving the finger 34.

Similarly, the shank 77 is equipped with two clips forming a fork for receiving a finger 44 belonging to the column 4.

Two elastic members 81 and 82 are respectively disposed between the fork 32 and the ends 73*a* and 73*b* of the tube 73, while other two elastic members 83 and 84 are disposed between the fork 42 and the ends 74*a* and 74*b* of the tube 74.

The function of the members 81 and 84 is to return the frame 7 and the forks 32 and 42 by default in the median position shown in FIGS. 1 to 4, i.e. in a position such that the respective axis of rotation of the wheels 5 and 6 is parallel to the axis Y–Y', which allows advance of the device 1 in a straight line.

When, due to an inclination of the device 1, one of the tubes 71, 72 comes into contact with the ground S, this has the effect of causing the frame 7 to pivot about axis $X_{28}$, which induces the transmission of an effort by one of the clips 76*a* or 76*a* to the finger 34. This induces a pivoting of the shaft 31 of the column 3 about the axis $A_{26}$. This results in a modification of the direction of the wheel 5 leading to a change in direction of the device 1 in the course of displacement.

Referring to FIGS. 5 and 6, it will be understood that, when a user wishes to advance in a straight line, including on sloping ground as shown in FIG. 5, it suffices for him to maintain his centre of gravity G in the plane defined by the axes X–X' and Z–Z', in which case the device 1 and its occupant move in the direction X–X' which is perpendicular to the plane of FIG. 5. Imagining that the user wishes to turn towards the left in FIG. 5, it suffices for him to lean over in order to displace his centre of gravity towards the side where he wishes to turn, which has the effect of bringing the tube 71 into contact with the ground S. Due to the force of reaction exerted by the ground, this induces a pivoting of the frame 7 about axis $X_{28}$ with respect to the chassis 2. Such pivoting induces a corresponding pivoting of the branches 76*a* and 76*b* of the shank 76 about axis $A_{28}$, in the direction of arrow $F_1$ in FIG. 7, this having the effect of pivoting the finger 34 about axis $A_{26}$ as represented by arrow $F_2$, the pivoting of the finger 34 inducing a corresponding pivoting of the column 3 and a change in orientation of the wheel 5. This pivoting of the column 3 is represented by arrow $F_3$ in FIG. 8.

In the same way, the pivoting of the frame 7 induces, thanks to the finger 44 and to the fork formed on the shank 77, a corresponding pivoting $F_3$ of the column and of the wheel 6, which makes it possible to attain the configuration shown in FIG. 8 or the trajectory T of the device 1 is substantially circular with a centre of curvature located on the left-hand side of FIG. 8.

If a lesser radius of curvature is to be attained, the user may accentuate the offset of his centre of gravity, which increases the pivoting of the frame 7 with respect to the chassis 2 and the rotation of the steering columns 3 and 4. He may also modify the position of the chassis 2 with respect to the frame in abutment on the ground by a bending movement of the ankles, inducing a variation of the angle of rotation of the columns 3 and 4.

It is also possible to use the device 1 in the manner shown in FIGS. 9 and 10 where the user is sitting on the board 22 of the chassis 2 and where it suffices for him to maintain his centre of gravity G aligned with the longitudinal axis X–X' of the device 1 in order to move in a straight line, as shown in FIG. 9, and to lean over to the side where he wishes to turn to bring the frame 7 into contact with the surface of the ground S and thus provoke rotation of the wheels 5 and 6, as shown in FIG. 10.

The invention has been shown with a device 1 equipped with two guiding wheels. However, it is applicable to the case of only one wheel being guiding, this guiding wheel being able to be the front wheel or the rear wheel of the device.

The frame 7 is not necessarily of continuous and closed form, it may take any geometry adapted to its function of abutment on the ground. The zone of contact between this frame and the ground may be equipped with casters or runners in order to limit the decelerations upon impact of the frame on the ground. The frame 7 is not necessarily completely rigid. For example, the struts 75 and 75' may be articulated with return into position by an elastic system in order to absorb the possible irregularities of the ground.

The definition of the value of the degrees of lock of the device 1 is obtained by the adjustment in longitudinal position of the clips 76*a*, 76*b* and equivalent with respect to the axis of rotation $A_{26}$ and equivalent of the steering columns 3 and 4. The degree of lock, which is therefore adjustable, may be identical or different for the two wheels 5 and 6 when the two wheels are guiding.

In order to improve the comfort of use of the device 1, the wheels may be wheels incorporating low pressure pneumatic tyre or rubber tyre. In a variant, one or more telescopic damping forks may be used. It is possible also to provide for the chassis 2 to have elastic memory.

According to a variant of the invention (not shown), the device 1 may be motorized, with transmission of the movement to one or the two wheels in order to go up slopes. It is also possible to provide using the ski-lifts of a skiable area in order to climb up a slope.

Members 81 to 84 may be replaced by other means for elastically returning the wheels and frame into configuration of rectilinear advance. A damping device comprising one or more pads made of elastomer may be used. Pneumatic or hydraulic jacks may also be used. The means for returning the frame 7 with respect to the chassis 2 and/or the wheels 5 and 6 may be positioned at different spots of the device 1 and not simply between the forks 32 and 42 and the frame 7. In particular, they may be integrated in the shanks 26 and 27 or 76 and 77. In that case, they work in torsion. These return means may be adjustable, which makes it possible to modify the sensations of piloting.

Similarly, the steering error angle of the steering columns 3 and 4, i.e. the value of the angles $\alpha$ and $\beta$ may be adjustable over a wide range, these angles not necessarily being equal to each other. The centre distance of axes of the steering columns 3 and 4 may also be adjustable, in the same way as the centre distance of axes of the wheels.

Other adjustments may be envisaged, such as the width of the frame 7 or the height h of its lowermost part, in the present case the tubes 71 and 72, with respect to the ground S in the configuration of FIGS. 1 and 3. The adjustment of this height determines the inclination necessary for starting a bend.

In the second form of embodiment of the invention shown in FIGS. 11 to 14, the elements similar to those of the first form of embodiment bear identical references increased by 100. The device 101 of this embodiment comprises a chassis 102 including a tubular cradle 121 and a supporting board 122 mounted on this cradle. The cradle 121 comprises two tubes 123 and 124 which are substantially parallel to a longitudinal axis X–X' of the device 101.

Two steering columns 103 and 104 are provided at the front and rear ends of the device 101 and are engaged inside shanks 126 and 127 forming shank for the columns. The columns 103 and 104 respectively comprise forks 132, 142 making it possible to control the orientation about two axes $A_{126}$ and $A_{127}$ of two wheels 105 and 106.

A frame 107 is articulated with respect to the chassis 102 and is substantially in the form of a closed loop, formed by two tubes 171 and 172 substantially parallel to the tubes 123 and 124 and connected by curved tubes 173 and 174.

A net 185, shown partially in FIGS. 11 to 14, is stretched between the frame 107 and the chassis 102 and avoids a user's feet sliding between the chassis 102 and the frame 107. The net 185 is made of elastic threads 186 whose tension tends to return the frame 7 into a median position corresponding to a rectilinear advance of the device 101. The elasticity of the net 185 may be adjusted by playing on the tension of the threads 186.

Furthermore, the frame 107 is provided, in the vicinity of the tube 173, with two extensions 178 and 179 formed by pieces of tube and projecting forwardly with respect to the tube 173. The extensions 178 and 179 each comprise two parts 178*a*, 178*b*, 179*a*, 179*b*, respectively, oriented in two directions substantially perpendicular with respect to each other.

A finger 134 for controlling the fork 132 is inserted in a sleeve 191 formed by a member 190 made of elastic plastics material, in which bores 192 for passage of parts 178*b* and 179*b* of the extensiosn 178 and 179 are also made.

The member 190 is made of supple plastics material, for example of synthetic or natural elastomer.

In this way, the member 190 constitutes an element for elastic connection between the frame 107 and the column 103, the control in rotation of the column 103 about the central axis $A_{126}$ of the shank 26 being effected through this member. It will be understood that the elastic nature of the member 190 tends to return the finger 134 into a position such that the wheel 105 is oriented substantially in the direction of axis X–X'.

Similarly, an elastic member 190' is provided to ensure the connection between the frame 107 and the column 104.

The frame 107 is also equipped with runners 194 intended to come into contact with the surface of the ground when the frame 107 bears thereon. These runners 194 are mounted by means of straps 195 in median zones 107*a* and 107*b* of the frame 107. On the left-hand side of FIG. 14, the straps 195 are shown in open configuration, before they are fastened in order to immobilize the corresponding runner 194 on the frame 107. The material of the runners 194 may be chosen to give them a certain elasticity allowing part of the shocks resulting from the bearing of the frame 7 on the ground at relatively high speed to be absorbed. The runners 194 are wearing pieces which may be the object of one or more standard exchanges during the life of the device 101.

Runners similar to runners 194 may, of course, be used with the devices in accordance with the other forms of embodiment described.

According to a variant of the invention (not shown), the runners 194 may be replaced by devices comprising casters or rollers bearing on the ground. Such devices are particularly adapted for movement of the device 101 over hard ground, of the tarmac type, particularly in an urban setting. Devices incorporating caster(s) or roller(s) may, of course, be used with the other forms of embodiment.

In the third form of embodiment shown in FIGS. 15 to 18, the elements similar to those of the first form of embodiment bear identical references increased by 200. The device 201 of this embodiment comprises a chassis 202 including a tubular cradle 221 and a supporting board 222. This board is equipped with retaining elements 222*a* in the form of an upturned U, under which the user can slide his feet with a view to a better hold on the board 222. The cradle 221 is formed by two tubes 223 and 224 each forming a loop and of which the two ends are welded on a shank 226, 227 respectively. The two tubes 223 and 224 thus constitute half-cradles which are connected by a tie-piece 225 of which the ends are shaped to receive the tubes 223 and 224 respectively, with possibility of rotation. The cradle 221 is thus deformable under the effect of the user's weight P.

As previously, two steering columns 203 and 204 are provided on the device 201 and comprise forks 232 and 242 for controlling two wheels 205 and 206 in rotation.

A frame 207 formed by curved tubes 271, 272, 273 and 274 is mounted on the device 201 so as to be able to come into contact with the ground by the median zones 207*a* and 207*b*.

A net 285 is stretched between the chassis 202 and the frame 107, on either side of the board 222.

Control of the fork 232 by the frame 207 is explained with reference to FIG. 18. A pin 251 is articulated with respect to the shank 226 by means of an articulation 252. This pin traverses a sleeve 253 welded on the frame 207. In fact, the sleeve 253 cuts the front part 273 of the frame 207 into two. The sleeve 253 is fast with a fork 254 of which the two branches 254*a* and 254*b* traverse an elastic member 255 mounted to slide with respect to a finger 234 for controlling the column 203 in rotation about the central axis $A_{226}$ of the shank 226. The elastic member 225 is capable of moving along the finger 234, as represented by double arrow $F_4$.

A compression spring 256 is disposed inside the sleeve 253 and around the pin 251 and abuts on washers 257 defining its housing inside the sleeve 253.

When the weight P of a user has the effect of deforming the cradle 221, by pivoting of the tubes 223 and 224 in the tie-piece 225, it is necessary to allow a relative movement of the frame 207, which is rigid, with respect to the cradle 221. This is possible, as the pin 251 may slide in the sleeve 253.

The spring 256 exerts on the end head 251*a* of the pin 251 a force $E_1$ which opposes the penetration of the head 251*a* in the sleeve 253 and thus compensates the clearance provided for the stroke of the pin 251 in the sleeve 253 and necessary for the deformation of the cradle 221.

The articulation 252 makes it possible to align the pin 251 and the sleeve 253, including in the case of deformation of the cradle 221.

The two branches 254*a* and 254*b*, which traverse the member 255 on either side of the finger 234, alternately compress the member 255 against the finger 234, depending on the direction of the bend to be effected.

A similar structure is provided at the level of the second steering column 204.

Damping blocks 286 are interposed between the board 222 and the half-cradles 223 and 224, in order to improve the comfort of use of the device 201.

In the fourth form of embodiment of the invention shown in FIG. 19, the elements similar to those of the first form of embodiment bear identical references increased by 300. The device 301 of this embodiment comprises a chassis 302 and two steering columns 303 and 304.

It differs from the preceding ones essentially in that its frame 307 is formed by two half-frames 307A and 307B kinematically connected to the front steering column 303 and to the rear steering column 304, respectively.

The half-frame 307A is in the form of an upturned handlebar and comprises end parts, of which only one is visible with reference 307$A_1$, intended to come into contact with the ground. In the same way, the rear half-frame 307B is provided with end parts, of which only one is visible with reference 307$B_1$, provided to come into contact with the ground. The respective end parts of the half-frames 307A and 307B are oriented rearwardly with respect to the zones of connection between these half-frames and the steering columns.

As a function of the relief of the terrain over which the device 301 is moving, the front (305) and rear (306) wheels of the device 301 may be controlled independently thanks to the half-frames 307A and 307B.

In the fifth form of embodiment of the invention shown in FIG. 20, the elements similar to those of the first form of embodiment bear identical references increased by 400. The device 401 of this embodiment also comprises a chassis 402 and steering columns of which only one is shown with reference 403. A frame 407 is provided to come into abutment on the ground and control in rotation a wheel 405 adapted to pivot about a central axis $A_{426}$ of a shank 426 forming a shaft for the steering column 403.

A ball-joint 451 is provided at the end of a finger 434 for controlling the fork 432 of the steering column 403 in rotation, this ball joint 451 allowing movements of pivoting of a fork 452 connected to an elastic member 453 similar to the member 255 of the third embodiment. The member 453 is mounted about a shaft 454 fixed with respect to the shank 426. In this way, the frame 407 may move transversely with respect to the shaft 454, as represented by the double arrow $F_5$, which makes it possible to control rotation of the fork 432 and of the wheel 405 about axis $A_{426}$.

In the sixth form of embodiment of the invention shown in FIG. 21, the elements similar to those of the first form of embodiment bear identical references increased by 500. The device 501 of this embodiment comprises a chassis 502 and a frame 507 intended to abut against the ground and articulated with respect to a shank 526 forming shank for a steering column 503 about an axis $X_{551}$ fixed with respect to the shank 526. A finger 534 is provided for the control in rotation of a fork 532 belonging to the column 503 for controlling the orientation of a wheel 505 with respect to a central axis $A_{526}$ of the shank 526. An elastically deformable cap 552 is provided to be mounted at the end of the finger 534 and connected to the frame 507 by two connecting rods 553 and 554.

The orientation of the wheel 505 with respect to the axis $A_{526}$ is controlled by means of the connecting rods 553 and 554 and the cap 552 whose elasticity makes it possible to return the wheel 505 into a median position corresponding to a rectilinear advance of the device 501.

In a variant, the connecting rods 551 and 554 may be replaced by cables stretched between the sleeve 552 and the frame 507.

In the seventh form of embodiment of the invention shown in FIG. 22, the elements similar to those of the first form of embodiment bear identical references increased by 600. The device 601 of this embodiment comprises a chassis 602 similar to those of the third and fourth embodiments. The frame 607 of this embodiment has a structure substantially in the form of an S and is kinematically connected by its respective ends 607A and 607B to means for controlling in rotation steering columns 603 and 604 provided respectively at the front and at the rear of the device 601 for controlling the position of two wheels 605 and 606.

The invention has been shown with a device 1 equipped with wheels. However, it is applicable with a device equipped with runners, particularly with a view to moving over a snow-covered surface. In practice, a device with two types of dismountable ground-engaging members, wheels or runners, may be envisaged, the wheels being used in the absence of snow, while the runners are used over snow-covered ground.

The invention has been shown with a device 1 capable of being used by one person. Use by a plurality of persons may be envisaged, in which case the dimension of the chassis is adapted.

The invention has been shown with a device 1 comprising a single wheel at the front and a single wheel at the rear of the chassis. It is applicable with a device comprising a plurality of wheels or runners at the front and/or at the rear of the chassis, these ground-engaging members being guiding, or not.

The invention has been shown with a device 1 provided with identical wheels at the front and at the rear. However, these wheels may be of different diameters.

The invention has been shown with devices of which the steering columns are inclined with respect to the vertical and convergent opposite the surface of the ground, as indicated hereinabove with reference to axes $A_{26}$ and $A_{27}$. However, it is possible to provide steering columns divergent opposite the surface of the ground, which increases the compactness of the device in length.

The means for immobilizing a user's feet, bearing reference 222*a* in FIG. 15, may be replaced by straps, cavities for accommodating the front part of the foot, or bindings of the type found on surfboards, or even alpine skis or sailboards.

The technical characteristics of the different forms of embodiment described may be combined together, and modifications may be made to the devices described without departing from the scope of the present invention as defined by the accompanying Claims.

What is claimed is:

1. Locomotion sporting device including a chassis adapted to accommodate at least one user, said chassis being supported by ground engaging members, at least one of said ground engaging members being mounted on a steering column articulated, with respect to said chassis, about an axis of rotation, a frame kinematically connected to said steering column and movable with respect to said chassis and adapted to come into contact with the ground, said frame making it possible, by movements with respect to said chassis during abutments against the ground, to control rotation of said steering column about said axis of rotation.

2. Device according to claim 1, including a ground engaging member disposed at one end of said chassis and another ground engaging member disposed at opposite end of said chassis.

3. Device according to claim 1 wherein said frame is articulated on said chassis about an axis substantially parallel to a direction of displacement of the device in a straight line.

4. Device according to claim 1 including adjustable means for connecting said frame and said steering column.

5. Device according to claim 1 wherein said frame is substantially in a form of a closed loop.

6. Device according to claim 1 wherein said frame is formed by two half-frames kinematically connected to a front steering column and to a rear steering column, respectively.

7. Device according to claim 1 wherein said frame is substantially in a form of an S or Z having ends which are kinematically connected to a front steering column and to a rear steering column, respectively.

8. Device according to claim 1 further including, at least one roller element mounted to said frame so as to come into contact with the ground.

9. Device according to claim 1 including at least one elastic net stretched between said chassis and said frame.

10. Device according to claim 1 wherein said chassis includes a cradle substantially in the form of a loop and covered with a board to support a user.

11. Device according to claim 1, including connecting means for connecting said frame and said steering column, said connecting means including means for returning said frame towards a position with respect to said chassis such that said at least one engaging member mounted on said steering column is oriented so that said device may move substantially in a straight line.

12. Device according to claim 1 wherein said ground engaging members include at least one runner.

13. Device according to claim 1 wherein said ground engaging members include at least one runner.

14. Device according the claim 2 wherein each engaging member is mounted on a separate steering column articulated with respect to said chassis and kinematically connected to said frame and said frame being adapted to control rotation of each steering column about its own axis of rotation.

15. Device according to claim 10 including damping means disposed between said cradle and said board.

16. Device according to claim 11 wherein said connection means including a member of supple material forming a sleeve adapted to surround an arm for controlling said steering column in rotation, said member forming at least one housing for receiving part of said frame.

17. Device according to claim 11, including an elastic member adapted to slide on an arm for controlling said steering column in rotation, said elastic member being secured to a sleeve connected to a shank of said steering column.

18. Device according to claim 11 wherein said connecting means includes a member articulated on an arm for controlling said steering column and forming a fork to cooperate with a shaft fixed with respect to a shank of said steering column.

19. Device according to claim 11 wherein said connection means includes an elastically deformable endpiece mounted on an arm for controlling said steering column and connected to said frame by connecting elements.

20. Device according to claim 14, characterized in that the axis of rotation of each column is inclined at an angle with respect to a vertical direction (Z–Z') when device rests on horizontal ground.

21. Device according to claim 14, including return means for returning said frame towards a position with respect to said chassis such that said engaging members mounted on said steering columns are oriented so that the device may move substantially in a straight line.

22. Device according to claim 14, wherein each steering column bears a catch extending in a direction substantially radial with respect to the axis of rotation thereof, and said frame being secured to a fork adapted to interact with said catch to control rotation of said steering columns about said axes of rotation.

23. Device according to claim 14 wherein said chassis includes a cradle formed by two half-cradles which are each secured to a separate one of said steering columns and which half-cradles are connected by a tie-piece.

24. Device according to claim 17 including a fork secured to said sleeve and adapted to alternately compress said elastic member against said arm for controlling said steering column.

25. Device according the claim 21, wherein said return means are elastic and have adjustable elasticity.

26. Device according to claim 21, including means for damping vibrations between the ground and a user in place on said chassis.

27. Device according to claim 22, characterized in the said half-cradles are articulated with respect to the tie-piece.

28. Device according to claim 22, wherein said half-cradles are covered with a board to support a user.

29. Device according to claim 23 including means for providing a damped clearance between said frame and said chassis to allow deformation of said cradle.

30. Device according to claim 26 wherein said means for damping vibrations includes wheels with resilient tires.

31. Device according to claim 26 wherein said means for damping vibrations includes at least one telescopic damping fork.

32. Device according to claim 26 wherein said means for damping vibrations includes shock absorbers.

33. Device according to claim 26 wherein said means for damping vibrations includes said chassis being formed of a material exhibiting elastic memory.

34. Device according to claim 29 wherein said means for providing a damped clearance includes a compression spring disposed inside a sleeve of each steering column, each sleeve being secured to said frame, each spring surrounding a pin which is articulated to a bush of said steering column connected to said chassis and exerting on a part thereof a clearance compensation force.

* * * * *